US009505553B2

(12) United States Patent
Goedken

(10) Patent No.: US 9,505,553 B2
(45) Date of Patent: Nov. 29, 2016

(54) AUTOMATED LOAD ARM MECHANISM FOR FRONT FORKS OF REFUSE COLLECTION TRUCK

(71) Applicant: Kann Manufacturing Corporation, Guttenberg, IA (US)

(72) Inventor: Kenneth D. Goedken, Dubuque, IA (US)

(73) Assignee: KANN MANUFACTURING CORPORATION, Guttenberg, IA (US)

( * ) Notice: Subject to any disclaimer, the term of this patent is extended or adjusted under 35 U.S.C. 154(b) by 196 days.

(21) Appl. No.: 14/341,120

(22) Filed: Jul. 25, 2014

(65) Prior Publication Data

US 2015/0030419 A1 Jan. 29, 2015

Related U.S. Application Data

(60) Provisional application No. 61/858,736, filed on Jul. 26, 2013.

(51) Int. Cl.
*B65F 3/04* (2006.01)
*B65F 3/02* (2006.01)

(52) U.S. Cl.
CPC ..... *B65F 3/04* (2013.01); *B65F 2003/023* (2013.01); *B65F 2003/0266* (2013.01); *B65F 2003/0279* (2013.01)

(58) Field of Classification Search
CPC ..... B65F 3/04; B65F 2003/023; B65F 2003/0266; B65F 2003/0279
USPC ..... 414/406, 408
See application file for complete search history.

(56) References Cited

U.S. PATENT DOCUMENTS 5,484,245 A * 1/1996 Zopf ..... B65F 3/041 414/406
5,577,877 A * 11/1996 Smith ..... B65F 1/0046 414/406
5,607,277 A * 3/1997 Zopf ..... B65F 3/041 414/408
5,690,465 A * 11/1997 Ledwell ..... B60P 1/26 414/408
5,931,628 A * 8/1999 Christenson ..... B65F 3/046 414/406
6,123,497 A * 9/2000 Duell ..... B65F 3/043 414/406
6,224,317 B1 * 5/2001 Kann ..... B65F 3/041 414/406
7,390,159 B2 6/2008 Rimsa et al.
7,871,233 B2 * 1/2011 Arrez ..... B65F 3/041 187/269
8,550,764 B2 * 10/2013 Rowland ..... B65F 3/041 414/408
8,753,062 B2 * 6/2014 Curotto ..... B65F 3/041 294/106
2005/0095096 A1 * 5/2005 Curotto ..... B65F 1/122 414/406

(Continued)

FOREIGN PATENT DOCUMENTS

ES EP 1584577 A2 * 10/2005 ..... B65F 3/04

*Primary Examiner* — James Buckle, Jr.
(74) *Attorney, Agent, or Firm* — Shuttleworth & Ingersoll, PLC; Brett Papendick

(57) ABSTRACT

A loading assembly for a refuse collection vehicle wherein a pair of gripping arms can upend a refuse container into an intermediate container. A first set of gripper arms can be located on a first side of the intermediate container and a second set of gripper arms can be located on a second side of the intermediate container. The two sets allow refuse bins located on a curb side and street side to be serviced by the loading assembly. The intermediate container can then be emptied into a storage compartment of the vehicle.

20 Claims, 6 Drawing Sheets

(56) References Cited

U.S. PATENT DOCUMENTS

2005/0095097 A1* 5/2005 Arrez ..... B65F 3/046
414/406
2010/0111655 A1* 5/2010 Weeks ..... B60P 1/4421
414/408
2010/0119340 A1* 5/2010 Flood ..... B65F 1/1484
414/406
2010/0322749 A1* 12/2010 Rowland ..... B65F 3/041
414/408
2014/0126983 A1* 5/2014 Goedken ..... B65F 3/041
414/408
2014/0341685 A1* 11/2014 Ford ..... B65F 3/041
414/408
2015/0093222 A1* 4/2015 Ford ..... B65F 3/041
414/406
2015/0093223 A1* 4/2015 Parker ..... B65F 3/041
414/408
2015/0307275 A1* 10/2015 Newkirk ..... B65F 3/041
414/408

* cited by examiner

AUTOMATED LOAD ARM MECHANISM FOR FRONT FORKS OF REFUSE COLLECTION TRUCK

CROSS-REFERENCE TO RELATED APPLICATIONS

The present application claims priority to provisional patent application 61/858,736 which was filed on Jul. 26, 2013, and is hereby expressly incorporated by reference in its entirety.

BACKGROUND

This invention pertains to collection of residential refuse containers by use of a front loading commodity collection truck with a top load opening.

Front loading refuse collection trucks are provided with front forks which are designed to reach into horizontally oriented sleeves on the sides of a front loadable commercial refuse container such that the container can be elevated and tipped by the lift arms of the truck to invert the refuse container over the top opening of the collection body carried on the truck. Those frontloading refuse collection trucks are capable of emptying only one kind of refuse container, namely a commercial front load container with horizontal sleeves mounted to the opposing side walls of the container.

Additional equipment to make a front loading commodity collection truck more versatile has been developed, such equipment including an intermediate container, frequently termed a "carry-can", which is carried on the front forks of the truck. The intermediate container is either filled manually by workers lifting residential refuse containers to tip them over the intermediate container, or the intermediate container may be filled by loading apparatus mounted on the intermediate container which can extend from the intermediate container and grasp an upright residential refuse container and upend it over the intermediate container so that the contents of the refuse container fall into the intermediate container. Existing loading apparatus of this kind requires the arm assembly to be mounted to the intermediate container and attached to the front forks as a unit.

BRIEF SUMMARY OF THE INVENTION

The present invention provides a fully automated loading assembly which is carried on the front forks of a front loading commodity collection truck independent from an intermediate container. The invention may operate toward one side of the collection truck or in an alternative embodiment the loading assembly may operate to collect a residential refuse container from either the curb side or the street side of the truck. The arm assembly is not dependent on the type or shape of intermediate container used and the arm assembly need not be removed from the forks while a commercial front loading container is emptied into the collection body.

If a commodity collection truck owner has purchased a curb side loading assembly according to this invention, the owner may subsequently add a street side loading assembly to the existing equipment, while both remain removable from the front forks of the truck. The truck owner is not constrained to purchase of a particular intermediate container to use with the loading assembly. If the loading assembly is damaged, the intermediate container need not be replaced as well.

By use of this invention, the owner of a front loading truck may use the truck to collect from residential containers which can be engaged with a pair of encircling gripper arms. Further, the owner may remove the invention and replace it without having to purchase a new intermediate container. The owner of the truck may return the truck to service as a front loading truck by removal of the intermediate container and arms.

DETAILED DESCRIPTION OF THE INVENTION

Figure 1:
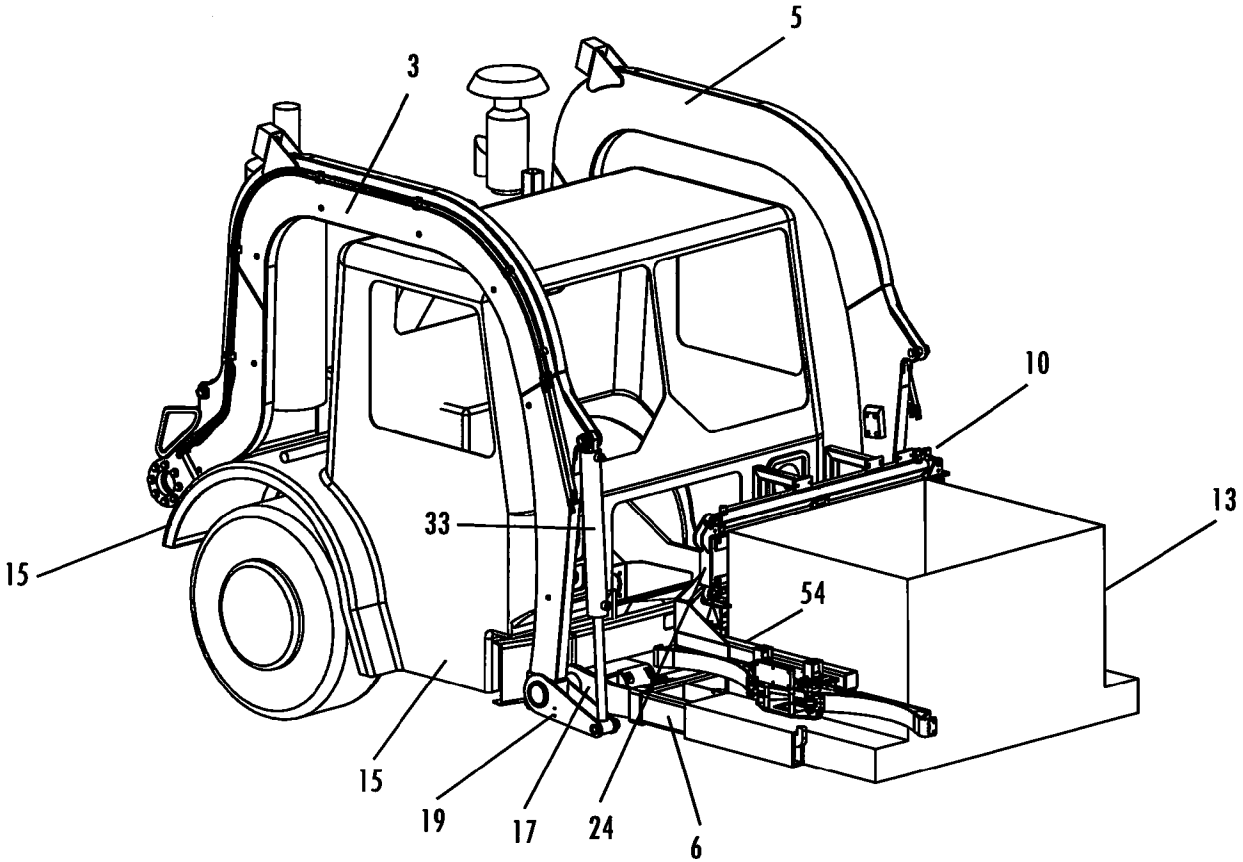
FIG. 1 is a front left perspective of an automated load arm mechanism carried on front forks of a front loading refuse collection truck, shown alongside an intermediate collection container also carried independently on the front forks of the truck.

FIG. 1 of the drawings illustrates a first embodiment of a curb side oriented automated load arm mechanism 10 mounted to the front fork assembly 17 of a front loading refuse collection truck 15. The load arm mechanism 10 is located between the cab 11 and an intermediate container 13 carried on the front fork assembly 17 of the refuse collection truck 15. The automated load arm mechanism 10 is removably supported on the front fork assembly 17 behind the intermediate container 13 which is also supported on the front fork assembly 17. The intermediate container 13 may be removed from the front forks 6, 8 without removal of the automated load arm mechanism 10 from the front forks 6, 8.

Figure 3:
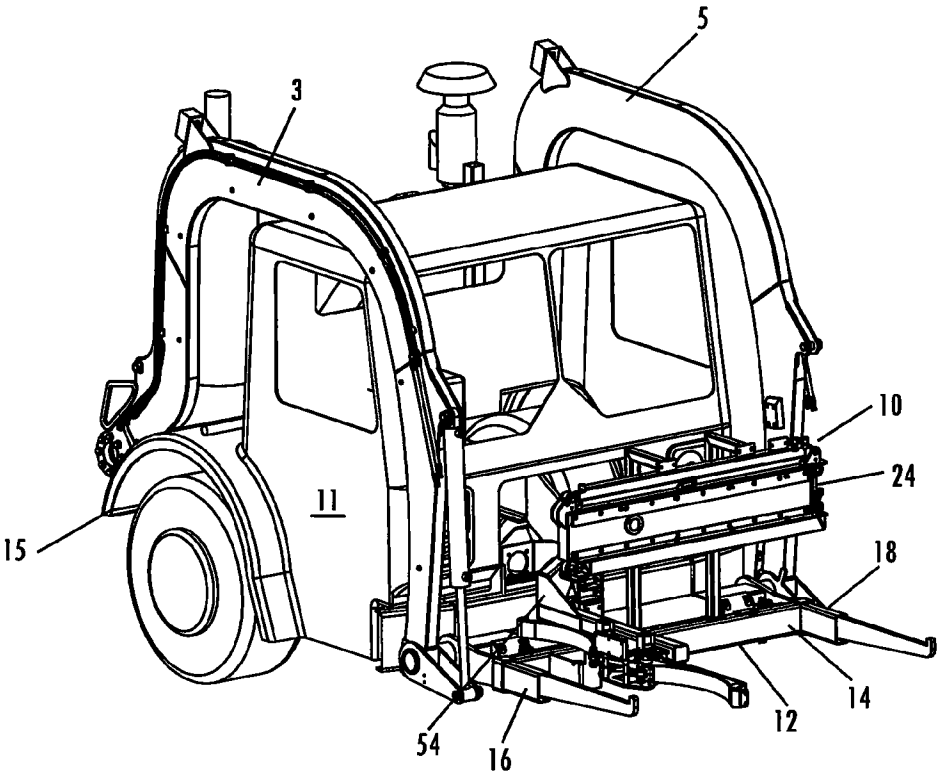
FIG. 3 is a front left perspective of the automated load arm mechanism of FIG. 1, without an intermediate container present.
Figure 3A:
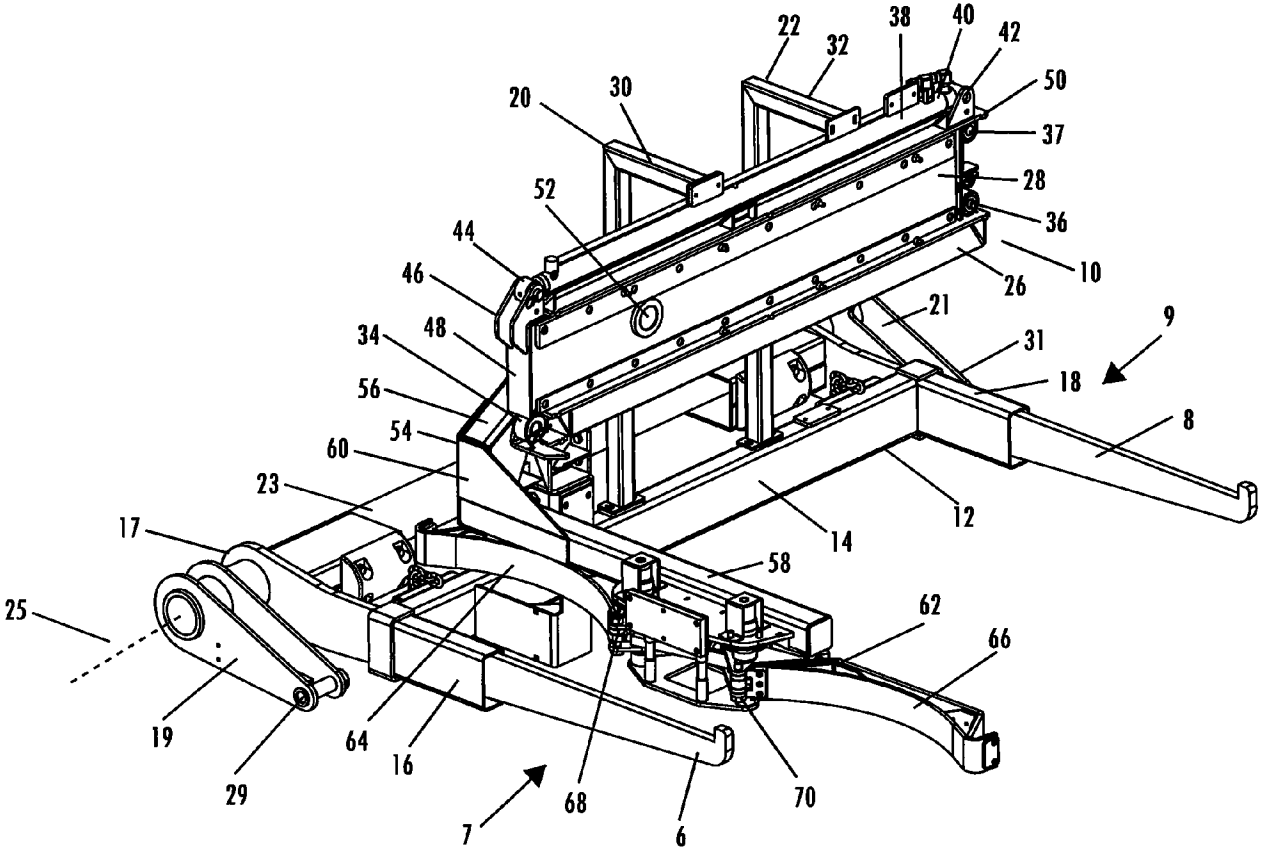
FIG. 3A is an enlarged perspective of the automated load arm mechanism of FIG. 3, shown attached to the front fork assembly of a front loading refuse collection truck.

Referring now additionally to FIGS. 3 and 3A, the automated load arm mechanism 10 includes a frame 12 which includes a pair of spaced apart sleeve elements 16, 18, each of which may receive one of the forks 6, 8 of the front fork assembly 17. The frame 12 further includes a cross beam 14 which joins the sleeve elements 16, 18. One or more vertical structural members such as standards 20, 22 are supported on and extend from cross beam 14. Each standard 20, 22 includes a horizontal bar element 30, 32 which extends forward from the standard 20, 22 and over the extender assembly 24 and the cross beam 14 of the automated load arm mechanism 10. The extender assembly 24 comprises a stationary elongate lateral bearing beam 26 along which elongate rail member 28 may be moved. The extender assembly 24 further includes a guide beam 50 along and above rail member 28. Both guide beam 50 and bearing beam 26 are joined to and supported by standards 20, 22. Rail member 28 may be generally the same horizontal length as that of guide beam 50 and bearing beam 26.

Roller bearings 34, 36 support rail member 28 and reduce friction as the rail member 28 moves along lateral bearing beam 26. Roller 37 reduces friction between rail member 28 and guide beam 50. A driver such as hydraulic cylinder 38 is attached at its head end 40 to guide beam 50 at mounting bracket 42 while the rod 44 of the hydraulic cylinder 38 is attached to rail member 28 by corner bracket 46 which is welded or otherwise fixed to rail member 28 at its first end 48. When rod 44 of hydraulic cylinder 38 is extended, rail member 28 is urged along lateral bearing beam 26 and under guide beam 50 toward the curb side 7 of the collection truck 15. As the rod 44 of hydraulic cylinder 38 is retracted, rail member 28 is urged along guide beam 50 and upon lateral bearing beam 26 back to its rest position centered over cross beam 14 as seen in FIGS. 3 and 3A.

Pivotably coupled to the rail member 28 at pivot axle 52 is an arm assembly 54 which may be moved in a substantially vertical arc around the pivot axle 52 of rail member 28. Pivot axle 52 is oriented transversely to the longitudinal axis 45 of rail member 28. Arm assembly 54 comprises pivot arm 56 which is joined perpendicularly to bar member 58 by a bracket member 60 which is generally L-shaped, so that bar member 58 is substantially perpendicular to pivot arm 56. Carried on the bar member 58 is a grappling assembly 62 which comprises a pair of gripper arms 64, 66 supported on gripper frame 74 such that gripper arms 64, 66 may pivot on gripper frame 74 and are operable to rotate toward each other to reach around a residential refuse bin to grasp the refuse bin along its height and to lift and manipulate the refuse bin, so the refuse bin can be upended over an intermediate container 13 such as is seen in FIG. 1.

Automated load arm mechanism 10 is removably fixed to front forks 6, 8 by anchor elements such as chains 67 which retain cross beam 14 to each of the front forks 6, 8.

Fork assembly 17 includes lever arms 19, 21 which rotate with main trunnion 23 to which forks 6, 8 are fixed. Front forks 6, 8 rotate about the longitudinal axis 25 of main trunnion 23 when drive cylinders 33 attached to the free ends 29, 31 of each lever arm 19, 21 are extended or retracted, the drive cylinders 33 being joined with the main lift arms 3, 5 of the collection truck 15. (See FIG. 1).

When a residential refuse bin is to be grasped by gripper arms 64, 66, each gripper arm 64, 66 is urged in rotation about a respective gripper arm pivot pin 68, 70 by action of hydraulic cylinders or other drivers carried on gripper frame 74 of arm assembly 54.

Figure 2:
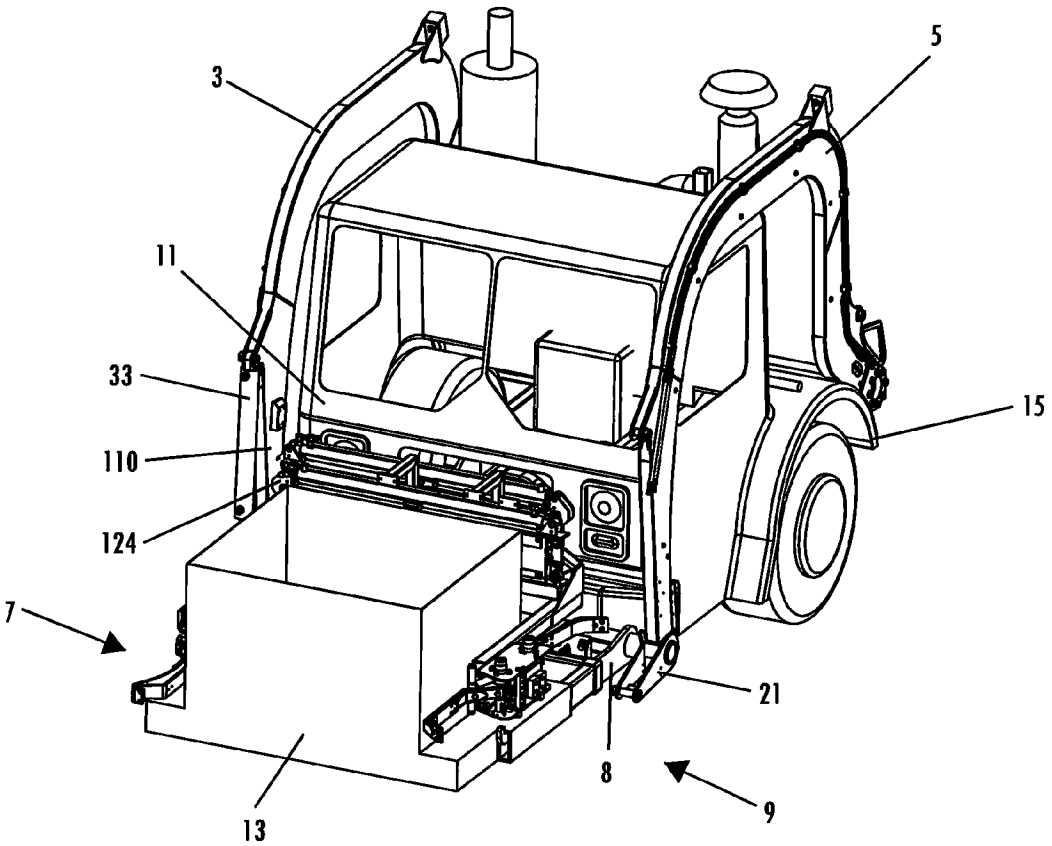
FIG. 2 is a front right perspective of an alternative embodiment automated load arm mechanism carried on the front forks of a front loading refuse collection truck, the alternative embodiment being adapted for emptying residential refuse bins into a intermediate collection container carried independently on the front forks, the load arm mechanism capable of collecting and emptying refuse bins located on either side of the collection truck.
Figure 4:
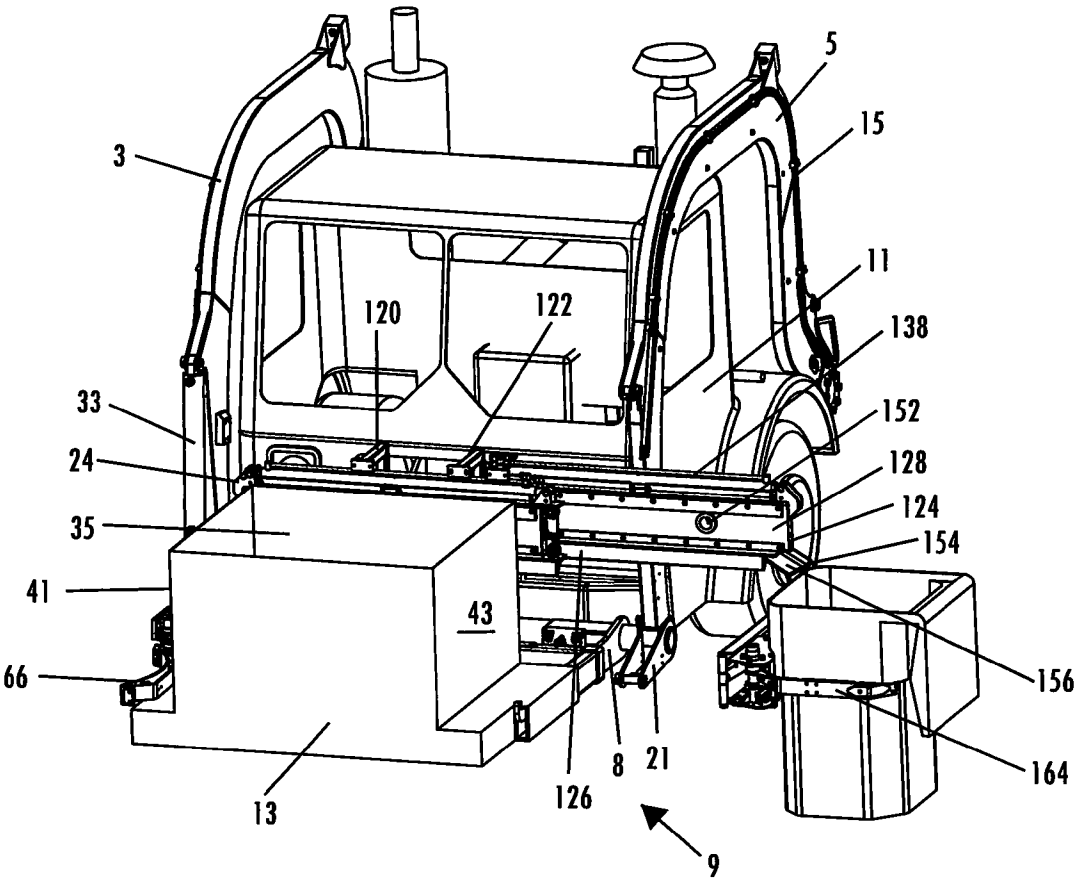
FIG. 4 is a front right perspective of the load arm mechanism of FIG. 2 with the load arm mechanism extended toward the street side of the collection truck and latched to a residential refuse bin.
Figure 5:
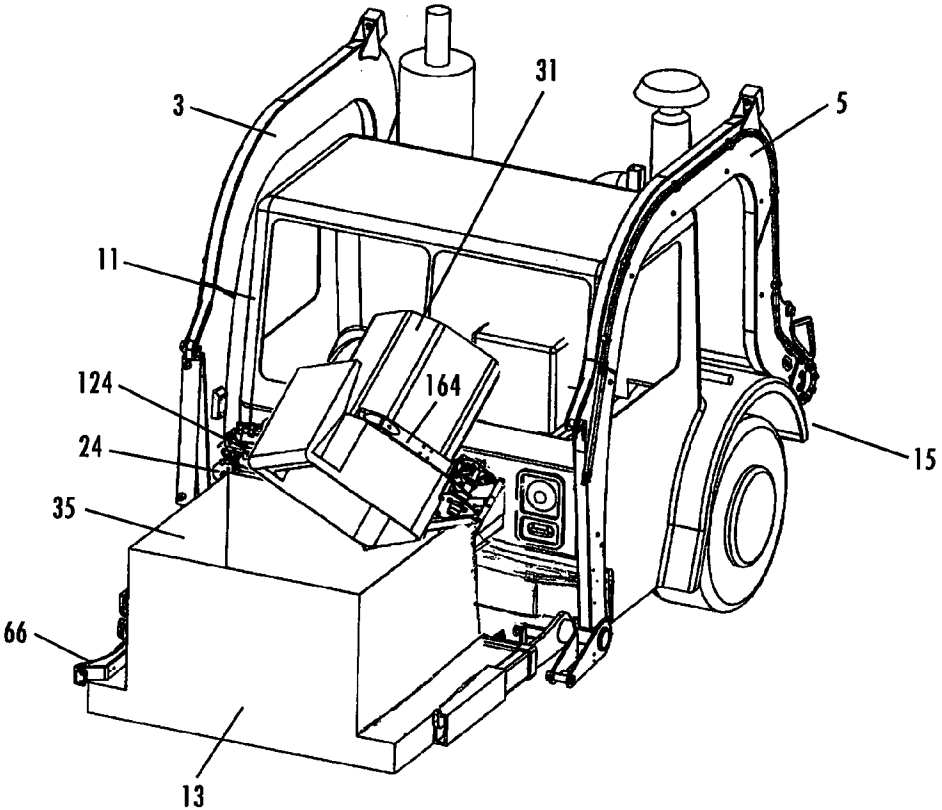
FIG. 5 is a front right perspective of the street side load arm assembly of FIG. 4 with the residential refuse bin tipped over the intermediate container.

Referring now to FIGS. 2, 4 and 5, a first alternative embodiment of the invention is illustrated. In the embodiment of FIGS. 2, 4 and 5, the load arm mechanism 110 comprises the extender assembly 24 of FIGS. 1, 3, 3A, and a second extender assembly 124 which is substantially a reverse version of the extender assembly 24. The second extender assembly 124 is mounted alongside first extender assembly 24. Second extender assembly 124 operates identically to first extender assembly 24 but in the opposite direction. Second extender assembly 124 is mounted to and supported by standards 20, 22, and is mounted between standards 20, 22 and cab 11. Second extender assembly 124 may be positioned at approximately the same height as extender assembly 24 but on the opposite sides of standards 20, 22 from the mounting of extender assembly 24.

In FIG. 2, the load arm mechanism 110 is shown with both the extender assembly 24 and second extender assembly 124 in their rest positions behind intermediate container 13 and forward of cab 11 of the commodity collection truck 15. The load arm mechanism 110 is supported on the front forks 6, 8 of the truck 15 and the intermediate container 13 also is carried on the front forks 6, 8 but the intermediate container 13 is independently removable from the front forks 6, 8 such that collection truck 15 may engage with and empty standard front end load containers having fork pockets, without the necessity of removing load arm mechanism 110.

In FIGS. 2, 4 and 5, one fork pivot cylinder 33 is shown in place on curb side lift arm 3. An equivalent fork pivot cylinder on the lift arm 5 has been omitted from the drawing. The fork pivot cylinder on lift arm 3 rotates trunnion lever arm 19 so that the fork pivot cylinders 33 can orient the intermediate can 13 as it is elevated over the truck cab 11 and then tipped into an upended position over a load opening of the commodity collection body (omitted) carried on the collection truck 15.

Like extender assembly 24, second extender assembly 124 supports an arm assembly 154 and arm assembly 154 supports the gripper arms 164, 166 which can extend and wrap around the body 33 of the typical upright residential refuse container 31, as seen in FIGS. 4 and 5. The pair of gripper arms 64, 66 is extendible toward the curb side 7 from the curb side fork 6 while the other pair of gripper arms 164, 166 is extendible toward the street side 9, over the street side fork 8.

Both extender assembly 24 and second extender assembly 124 are supported on frame 12 which includes sleeves 16, 18 which may selectively receive the forks 6, 8 therein. Sleeves 6, 8 will be oriented generally horizontally when the front forks 6, 8 are in the lowered position extending generally horizontally forward from the cab 11 of the truck 15.

Referring particularly to FIG. 4, the second extender assembly 124 is shown in a fully extended position, such that rail member 128 extends substantially horizontally and perpendicularly from the longitudinal axis 39 of street side fork 8.

Second extender assembly 124 is supported on an elongate bearing beam 126 similar to bearing beam 26 of the extender assembly 24 illustrated in FIG. 3A. Like extender assembly 24, second extender assembly 124 includes a rail member 128 which is moved along the bearing beam 126 by a hydraulic cylinder 138 or equivalent driver.

In FIG. 4 it is seen that the second extender assembly 124 has been extended toward the street side 9 of the collection truck 15, passing over street side fork 8, and the arm assembly 154 has been raised and oriented to grasp residential refuse container 31 about the body 33 of refuse container 31. Gripper arms 164, 166 have been closed around the body 33 along its height so that the refuse container 31 can be lifted slightly and drawn toward intermediate container 13 as second extender assembly 124 is retracted by the hydraulic cylinder 138.

Referring now to FIG. 5, the second arm assembly 154 has been operated to rotate pivot arm 156 about pivot pin 152 which is supported on rail member 128 (as with rail member 28 and pivot pin 52) and second extender assembly 124 has been retracted so that second extender assembly 124 is positioned in its rest position behind intermediate container 13. The pivot arm 156 of arm assembly 124 has been rotated about pivot pin 152 so that the gripper arms 164, 166 grasping the refuse container 31 cause the refuse container 31 to be substantially tipped into an upended position such that the contents of the refuse container 31 will fall into the top opening 35 of the intermediate container 13.

With both extender arm 24 and second extender 124 of load arm mechanism 110 retracted into their respective rest positions with both sets of gripper arms 64, 66, 164, 166 resting alongside opposing side walls 41, 43 of the intermediate container 13 as illustrated in FIG. 2, the main lift arms 3, 5 of collection truck 15 may raise the forks 6, 8 to elevate intermediate container 13 to a position over the top load opening of the commodity collection body (omitted from figures) positioned behind cab 11 such that the intermediate container 13 can be upended through retraction of the pivot cylinders 33 and the contents of intermediate container 13 may drop into the load opening of the commodity collection body. Load arm mechanism 110 need not be removed when the intermediate container 13 is emptied into the collection body.

The foregoing description of the invention embodiments has been presented for purposes of illustration and description and is not intended to be exhaustive or to limit the invention to the precise form disclosed. Modifications and variations of the embodiments are possible in light of the above disclosure or such may be acquired through practice of the invention. The embodiments illustrated were chosen in order to explain the principles of the invention and its practical application in order to enable one skilled in the art to utilize the invention in various embodiments and with various modifications as are suited to the particular use contemplated. It is intended that the scope of the invention be defined by the claims appended hereto, and by their equivalents.

The invention claimed is:

1. A loading assembly for a front loading commodity collection vehicle having a pair of forks carried on main lift arms, the loading assembly comprising:
- a frame comprising spaced apart sleeves;
- the sleeves adapted to selectively receive the pair of forks;
- the frame further comprising an extender assembly movable substantially horizontally and perpendicularly relative to a longitudinal axis of each fork;
- the extender assembly comprising a movable elongate rail member;
- a drive member for selectively moving the rail member;
- the rail member movable horizontally to a position overlying a one of the pairs of forks;
- an arm assembly pivotably supported on the rail member;
- the arm assembly pivotal about a pivot axle carried by the rail member;
- the arm assembly including plural gripper arms whereby the gripper arms are selectively operable to grasp a body of a residential refuse bin;
- whereby the arm assembly is selectively movable to upend the residential refuse bin over a top opening of an intermediate container removably supported on the pair of forks.

2. The loading assembly of claim 1, wherein:
- the gripper arms substantially parallel to the longitudinal axis of each fork.

3. The loading assembly of claim 2, wherein:
- the pivot axle is oriented transversely to a longitudinal axis of the rail member.

4. The loading assembly of claim 3, wherein:
- the rail member is movable via roller bearings.

5. The loading assembly of claim 4, wherein:
- the arm assembly is moved in a substantially vertical arc around the pivot axle.

6. The loading assembly of claim 5, wherein:
- the gripper arms are operable to rotate toward each other.

7. The loading assembly of claim 6, wherein:
- the gripper arms are driven by hydraulic cylinders.

8. The loading assembly of claim 7, wherein:
- anchor elements are joined to the frame to selectively affix the frame to the forks.

9. A dual sided load arm assembly for a front loading commodity collection truck having a pair of front forks operable between a load position and an unload position, the invention comprising:
- a frame receivable on the front forks;
- the frame supporting a first extender assembly and a second extender assembly;
- each of the extender assemblies comprising an elongate horizontally oriented rail member supported movably along an elongate support beam;
- each rail member independently and selectively movable along the support beam on which it is supported;
- each rail member movable to any position between a fully retracted position and a fully extended position;
- each extender assembly including an arm assembly pivotable about a pivot axle on the rail member;
- each arm assembly including a pair of gripper arms wherein each pair of gripper arms can grasp a residential refuse container;
- wherein an intermediate container may be supported on the front forks alongside the load arm assembly;
- and wherein either of the pairs of gripper arms may upend the residential refuse container over a top opening of the intermediate container;
- and wherein the intermediate container may be elevated by a pair of lift arms supported on the commodity collection truck and upended by the front forks over a top load opening of a commodity collection body carried on the commodity collection truck.

10. The arm assembly of claim 9, wherein:
- each pivot axle is transverse to a longitudinal axis of the rail member.

11. The arm assembly of claim 10, wherein:
- the frame comprises spaced apart sleeves;
- the sleeves adapted to selectively receive the pair of forks.

12. The arm assembly of claim 11, wherein:
- the gripper arms substantially parallel to a longitudinal axis of each fork.

13. The arm assembly of claim 12, wherein:
- each rail member is movable via roller bearings.

14. The arm assembly of claim 13, wherein:
- each of the extender assemblies is moved in a substantially vertical arc around the pivot axle.

15. The arm assembly of claim 14, wherein:
- the gripper arms are operable toward each other.

16. The arm assembly of claim 15, wherein:
- the gripper arms are driven by hydraulic cylinders.

17. The arm assembly of claim 16, wherein:
- anchor elements are joined to the frame to selectively affix the frame to the forks.

18. A loading assembly for a front loading commodity vehicle having a pair of forks, comprising:
- a frame attachable to the vehicle;
- the frame further comprising an extender assembly movable substantially horizontally and perpendicularly relative to a longitudinal axis of a pair of forks;
- a movable elongate rail member;
- an arm assembly pivotably supported on the rail member;
- the arm assembly comprising gripper arms;
- a pair of gripper arms on a first side of the rail member;
- a pair of gripper arms on a second side of the rail member;

the frame comprising spaced apart sleeves;

wherein the sleeves are adapted to selectively receive the pair of forks;

wherein the arm assembly is selectively movable to upend a refuse bin.

19. The loading assembly of claim 18, wherein:

the arm assembly is moved in a substantially vertical arc around a pivot axle.

20. The loading assembly of claim 19, wherein:

the forks can secure an intermediate container whereby the arm assembly upends the refuse bin over the intermediate container.

* * * * *